US005588989A

United States Patent [19]

Vonk et al.

[11] Patent Number: 5,588,989

[45] Date of Patent: Dec. 31, 1996

[54] ZINC PHOSPHATE COATING COMPOSITIONS CONTAINING OXIME ACCELERATORS

[75] Inventors: Donald R. Vonk, Clinton Township; Jeffrey A. Greene, Ferndale, both of Mich.

[73] Assignee: PPG Industries, Inc., Pittsburgh, Pa.

[21] Appl. No.: 344,441

[22] Filed: Nov. 23, 1994

[51] Int. Cl.[6] ..... C23C 22/07

[52] U.S. Cl. ..... 106/14.12; 106/14.41; 106/14.42; 106/14.44; 148/259; 148/260

[58] Field of Search ..... 148/259, 260; 106/14.12, 14.42, 14.41, 14.44

[56] References Cited

U.S. PATENT DOCUMENTS

| | | | |
|---|---|---|---|
| 2,298,280 | 10/1942 | Clifford et al. | 148/260 |
| 2,743,204 | 4/1956 | Russell | 148/260 |
| 2,874,081 | 2/1959 | Cavanagh et al. | 148/254 |
| 2,884,351 | 4/1959 | Cavanagh et al. | 148/260 |
| 3,637,533 | 1/1972 | Dahill, Jr. | 252/522 |
| 3,867,506 | 2/1975 | Skarbo et al. | 423/139 |
| 3,907,966 | 9/1975 | Skarbo | 423/139 |
| 3,923,554 | 12/1975 | Ziemba | 148/260 |
| 3,975,214 | 8/1976 | Kulick et al. | 148/257 |
| 4,003,761 | 1/1977 | Gotta et al. | 148/259 |
| 4,029,704 | 6/1977 | Anderson | 260/566 A |
| 4,108,817 | 8/1978 | Lochel, Jr. | 148/251 |
| 4,149,909 | 4/1979 | Hamilton | 148/260 |
| 4,186,035 | 1/1980 | Cawley et al. | 148/249 |
| 4,292,096 | 9/1981 | Murakami et al. | 148/262 |
| 4,335,243 | 6/1982 | Michne | 546/97 |
| 4,338,141 | 7/1982 | Senzaki et al. | 148/262 |
| 4,389,260 | 6/1983 | Hauffe et al. | 148/262 |
| 4,433,015 | 2/1984 | Lindert | 148/251 |
| 4,457,790 | 7/1984 | Lindert et al. | 148/247 |
| 4,673,444 | 6/1987 | Saito et al. | 148/264 |
| 4,725,320 | 2/1988 | Tury et al. | 148/273 |
| 4,793,867 | 12/1988 | Charles et al. | 148/262 |
| 4,838,957 | 6/1989 | Miyamoto et al. | 148/260 |
| 4,865,653 | 9/1989 | Kramer | 204/38.1 |
| 5,176,843 | 1/1993 | Dalton et al. | 252/184 |
| 5,219,481 | 6/1993 | Lawson | 106/14.15 |
| 5,312,491 | 5/1994 | Binter | 148/272 |

FOREIGN PATENT DOCUMENTS

| | | | |
|---|---|---|---|
| 0125025 | 11/1984 | European Pat. Off. . | |
| 0315059 | 5/1989 | European Pat. Off. . | |
| 1294077 | 4/1962 | France . | |
| 1222351 | 8/1966 | Germany | 148/259 |
| 57-054279 | 3/1982 | Japan . | |

*Primary Examiner*—Anthony Green
*Attorney, Agent, or Firm*—William J. Uhl; Kenneth J. Stachel

[57] ABSTRACT

Zinc phosphate coating compositions containing an oxime accelerator are disclosed. The oxime accelerators are environmentally friendly and are stable in the acidic environment of the zinc phosphate coating compositions enabling the formation of a one-package system.

33 Claims, No Drawings

ZINC PHOSPHATE COATING COMPOSITIONS CONTAINING OXIME ACCELERATORS

FIELD OF THE INVENTION

The present invention relates to an aqueous acidic phosphate coating composition containing a stable accelerator; to a concentrate for preparing such compositions; to a process for forming a zinc phosphate coating on a metal substrate using such compositions and to the resultant coated metal substrate.

BACKGROUND OF THE INVENTION

It has long been known that the formation of a zinc phosphate coating also known as a zinc phosphate conversion coating on a metal substrate is beneficial in providing corrosion resistance and also in enhancing the adherence of paint to the coated metal substrate. Zinc phosphate coatings are especially useful on substrates which comprise more than one metal, such as automobile bodies or parts, which typically include steel, zinc coated steel, aluminum, zinc and their alloys. The zinc phosphate coatings may be applied to the metal substrate by dipping the metal substrate in the zinc phosphate coating composition, spraying the composition onto the metal substrate, or using various combinations of dipping and spraying. It is important that the coating be applied completely and evenly over the surface of the substrate and that the coating application not be time or labor intensive.

The zinc phosphate coating compositions are acidic and contain zinc ion and phosphate ion, as well as, additional ions, such as manganese ion, depending upon the particular application. In order to speed up the zinc phosphate coating application to metals, accelerators are often added to a zinc phosphate coating composition. A typical accelerator is nitrite ions, provided by the addition of a nitrite ion source such as sodium nitrite, ammonium nitrite, or the like to the zinc phosphate coating composition. Nitrites, however, are not stable in the acidic environment of the zinc phosphate coating composition and decompose to nitrogen oxides which do not exhibit accelerating capability. Therefore, stable one-package coating compositions cannot be formulated; rather the nitrite must be added to the zinc phosphate coating composition shortly before use. Another disadvantage of the nitrite accelerator is that they provide by-products that cause waste treatment problems when the spent zinc phosphating solution is disposed. It would be desirable to have an accelerator which is stable in the acidic environment of the zinc phosphate coating composition and which is environmentally acceptable.

Other accelerators have also been proposed for use in zinc phosphate coating compositions, including accelerators such as aromatic nitro compounds, particularly m-nitrobenzenesulfonate ion, chlorate ion, hydroxylamine ion, and hydrogen peroxid.

It is an object of the present invention to provide a zinc phosphate coating composition that includes a novel accelerating agent which provides excellent coating properties, is stable in that it will not decompose in the acidic environment of a zinc phosphating solution and which is environmentally acceptable.

SUMMARY OF THE INVENTION

The present invention provides an aqueous acidic composition for forming a zinc phosphate coating on a metal substrate comprising about 0.4 to 3.0 grams per liter (g/l) of zinc ion, about 5 to 20 g/l phosphate ion and as an accelerator, about 0.5 to 20 g/l of an oxime.

The present invention also provides for an aqueous acidic concentrate which upon dilution-with aqueous medium forms an aqueous acidic composition as described above comprising about 10 to 100 g/l of zinc ion, 100 to 400 g/l phosphate ion and as an accelerator about 10 to 400 g/l of an oxime.

The present invention further provides a process for forming a zinc phosphate coating on a metal substrate comprising contacting the metal with an aqueous acidic zinc phosphate coating composition as described above.

The present invention also provides for a metal substrate containing from 1.0 to 6.0 grams per square meter ($g/m^2$) of a zinc phosphate coating applied by the process described above.

DETAILED DESCRIPTION

The zinc ion content of the aqueous acidic compositions is preferably between about 0.5 to 1.5 g/l and is more preferably about 0.8 to 1.2 g/l, while the phosphate content is preferably between about 8 to 20 g/l, and more preferably about 12 to 14 g/l. The source of the zinc ion may be conventional zinc ion sources, such as zinc nitrate, zinc oxide, zinc carbonate, zinc metal, and the like, while the source of phosphate ion may be phosphoric acid, monosodium phosphate, disodium phosphate, and the like. The aqueous acidic zinc phosphate composition typically has a pH of between about 2.5 to 5.5 and preferably between about 3.0 to 3.5.

The oxime content of the aqueous acidic compositions is an amount sufficient to accelerate the formation of the zinc phosphate coating and is usually added in an amount of about 0.5 to 20 g/l, preferably between about 1 to 10 g/l, and most preferable in an amount between about 1 to 5 g/l. The oxime is one which is soluble in aqueous acidic compositions and is stable in such solutions, that is it will not prematurely decompose and lose its activity, at a pH of between 2.5 and 5.5, for a sufficient time to accelerate the formation of the zinc phosphate coating on a metal substrate. Especially useful oximes are acetaldehyde oxime which is preferred and acetoxime.

In addition to the zinc ion, the phosphate ion and oxime, the aqueous acidic phosphate compositions may contain fluoride ion, nitrate ion, and various metal ions, such as nickel ion, cobalt ion, calcium ion, magnesium ion, manganese ion, iron ion, and the like. When present, fluoride ion should be in an amount of about 0.1 to 2.5 g/l and preferably between about 0.25 to 1.0 g/l; nitrate ion in an amount of about 1 to 10 g/l, preferably between about 2 to 5 g/l; nickel ion in an amount of 0 to about 1.8 g/l, preferably about 0.2 to 1.2 g/l, and more preferably between about 0.3 to 0.8 g/l; calcium ion in an amount of about 0 to 4.0 g/l, preferably between about 0.2 to 2.5 g/l; manganese ion in an amount of 0 to about 1.5 g/l, preferably about 0.2 to 1.5 g/l, and more preferably between about 0.8 to 1.0 g/l; iron ion in an amount of about 0 to 0.5 g/l, preferably between about 0.005 to 0.3 g/l.

It has been found especially useful to provide fluoride ion in the acidic aqueous zinc phosphate coating compositions, preferably in an amount of about 0.25 to 1.0 g/l, in combination with the oxime, preferably acetaldehyde oxime. The source of the fluoride ion may be free fluoride such as derived from ammonium bifluoride, hydrogen fluoride, sodium fluoride, potassium fluoride, or complex fluoride ions such as fluoroborate ion or a fluorosilicate ion. Mixtures of free and complex fluorides may also be used. Fluoride ion in combination with the oxime typically lowers the amount of oxime required to achieve equivalent performance of nitrite accelerated compositions.

In addition to the oxime accelerator, accelerators other than nitrites may be used with the oxime accelerator. Typical accelerators are those know in the art, such as aromatic nitro-compounds, including sodium nitrobenzene sulfonates, particularly sodium m-nitrobenzene sulfonate, chlorate ion and hydrogen peroxide. These additional accelerators, when used, are present in amounts of from about 0.005 to 5.0 g/l.

An especially useful aqueous acidic zinc phosphate composition according to the present invention is one having a pH of between about 3.0 to 3.5 containing about 0.8 to 1.2 g/l of zinc ion, about 12 to 14 g/l of phosphate ion, about 0.3 to 0.8 g/l of nickel ion, about 0.8 to 1.0 g/l of manganese ion, about 2.0 to 5.0 g/l of nitrate ion, about 0.25 to 1.0 g/l of fluoride ion, about 0.5–1.5 g/l of acetaldehyde oxime and about 0.1–0.3 g/l, particularly about 0.3 g/l of sodium nitrobenzene sulfonate.

The aqueous acidic composition of the present invention can be prepared fresh with the above mentioned ingredients in the concentrations specified or can be prepared in the form of aqueous concentrates in which the concentration of the various ingredients is considerably higher. Concentrates are generally prepared beforehand and shipped to the application site where they are diluted with aqueous medium such as water or are diluted by feeding them into a zinc phosphating composition which has been in use for some time. Concentrates are a practical way of replacing the active ingredients. In addition the oxime accelerators of the present invention are stable in the concentrates, that is they do not prematurely decompose, which is an advantage over nitrite accelerators which are unstable in acidic concentrates. Typical concentrates would usually contain from about 10 to 100 g/l zinc ion, preferably 10 to 30 g/l zinc ion, and more preferably about 16 to 20 g/l of zinc ion and about 100 to 400 g/l phosphate ion, preferably 160 to 400 g/l phosphate ion, and more preferably about 240 to 280 g/l of phosphate ion and as an accelerator about 10 to 400 g/l, preferably about 10 to 40 g/l of an oxime. Optional ingredients, such as fluoride ion are usually present in the concentrates in amounts of about 2 to 30 g/l, preferably about 5 to 20 g/l. Other optional ingredients include manganese ion present in amounts of about 4.0 to 40.0 g/l, preferably about 15.0 to 20.0 g/l; nickel ion present in amounts of about 4 to 24, preferably 4.0 to 12.0 g/l; nitrate ion present in amounts of about 20 to 200 g/l, preferably 30 to 100 g/l. Other metal ions, such as, cobalt, calcium and magnesium can be present. Additional accelerators, such as, hydrogen peroxide, sodium nitrobenzenesulfonate and chlorate ion can also be present.

The aqueous acidic composition of the present invention is usable to coat metal substrates composed of various metal compositions, such as the ferrous metals, steel, galvanized steel, or steel alloys, zinc or zinc alloys, and other metal compositions such as aluminum or aluminum alloys. Typically a substrate such as an automobile body will have more than one metal or alloy associated with it and the zinc phosphate coating compositions of the present invention are particularly useful in coating such substrates.

The aqueous acidic zinc compositions of the present invention may be applied to a metal substrate by known application techniques, such as dipping, spraying, intermittent spraying, dipping followed by spraying or spraying followed by dipping. Typically, the aqueous acidic composition is applied to the metal substrate at temperatures of about 90° F. to 160° F. (32° C. to 71° C.), and preferably at temperatures of between about 120° F. to 130° F. (49° C. to 54° C.). The contact time for the application of the zinc phosphate coating composition is generally between about 0.5 to 5 minutes when dipping the metal substrate in the aqueous acidic composition and between about 0.5 to 3.0 minutes when the aqueous acidic composition is sprayed onto the metal substrate.

The resulting coating on the substrate is continuous and uniform with a crystalline structure which can be platelet, columnar or nodular. The coating weight is about 1.0 to 6.0 grams per square meter ($g/m^2$).

It will also be appreciated that certain other steps may be done both prior to and after the application of the coating by the processes of the present invention. For example, the substrate being coated is preferably first cleaned to remove grease, dirt, or other extraneous matter. This is usually done by employing conventional cleaning procedures and materials. These would include, for example, mild or strong alkali cleaners, acidic cleaners, and the like. Such cleaners are generally followed and/or preceded by a water rinse.

It is preferred to employ a conditioning step following or as part of the cleaning step, such as disclosed in U.S. Pat. Nos. 2,874,081; and 2,884,351. The conditioning step involves application of a condensed titanium phosphate solution to the metal substrate. The conditioning step provides nucleation sites on the surface of the metal substrate resulting in the formation of a densely packed crystalline coating which enhances performance.

After the zinc phosphate conversion coating is formed, it is advantageous to subject the coating to a post-treatment rinse to seal the coating and improve performance. The rinse composition may contain chromium (trivalent and/or hexavalent) or may be chromium-free. Chromium post-treatment would include, for example, about 0.005 to about 0.1 percent by weight chromium ($Cr^{+3}$, $Cr^{+6}$, or mixtures thereof). Chromium-free rinses can incorporate zirconium compounds may also be employed. See for example, U.S. Pat. Nos. 3,975,214; 4,457,790; and 4,157,028.

The invention will be further understood from the following non-limiting examples, which are provided to illustrate the invention and in which all parts indicated are parts by weight unless otherwise specified.

EXAMPLES

The following examples show the compositions of various aqueous acidic compositions of the present invention, processes for applying the compositions to metal substrates, and the evaluation of the resultant zinc phosphate coatings. Comparative examples of zinc phosphate coatings with nitrite accelerators are also provided. The resultant zinc phosphate coatings were evaluated for crystal size and type and coating weight achieved.

Examples I–XVI in Tables I and II demonstrate the aqueous acidic compositions of the present invention and comparative examples. Tables III–VIII show the results of the evaluation of the aqueous acidic compositions of Examples IX–VI on three metal substrates. Examples XVI-I–XXII in Tables IX and X demonstrate examples of aqueous acidic concentrates of the present invention and the preparation and dilution of these concentrates for use.

Examples II–VI, Examples IX–X and Examples XIV–XVI demonstrate the zinc phosphate coating compositions and process of the present invention and their application to metal substrates by dipping. Examples I, VII and VIII are comparative examples which were accelerated with sodium nitrite.

The following treatment process was used for examples I–X.

(a) degreasing: the test panels were first cleaned using an alkaline degreasing agent ("CHEMKLEEN 166/171ALX" available from PPG Industries, Inc. at 2% by weight) which was sprayed on to the metal substrates at 55° C. for 1 minute;

(b) rinsing: the test panels were then rinsed with tap water at room temperature for 15 to 30 seconds;

(c) conditioning: the rinsed test panels were then dipped into a surface conditioner ("PPG Rinse Conditioner" available from PPG Industries, Inc. at 0.1% by weight) at room temperature for 1 minute; followed by (d) phosphating: in which the test panels were dipped into acidic aqueous compositions given in Table I at 52°–55° C. for 2 minutes;

(e) rinsing: the coated test panels were then rinsed with tap water at room temperature for 15 seconds.

Example XI is an example of the present invention applied by spray application techniques. The treatment process for Examples I–X was used, with the exception of "d" the phosphating step, where the test panels were sprayed with the aqueous acidic composition given in Table II at 52°–55° C. for 1 minute.

Examples XII and XIII are comparative examples which were accelerated with sodium nitrite. The treatment process for Examples XII, XIV, and XVI was similar to the process for Examples I–X with two exceptions. In step "a", the metal substrates were degreased with "CHEMKLEEN 163" available from PPG Industries at 2% by weight and in step "c" the rinse conditioner concentration was 0.2% by weight.

The treatment process for Examples XIII and XV was similar to the process of Examples XII, XIV, and XVI with the exception of step "c" in which the rinse conditioner concentration was 0.1% by weight.

TABLE I

Aqueous Acidic Zinc Phosphate Coating Compositions

| Concentration | EXAMPLE NUMBER | | | | | | | | | |
|---|---|---|---|---|---|---|---|---|---|---|
| (grams/liter) | I | II | III | IV | V | VI | VII | VIII | IX | X |
| Zn | 0.77 | 1.87 | 1.54 | 1.12 | 0.93 | 1.23 | 0.96 | 0.90 | 0.63 | 0.61 |
| Ni | 0.43 | 0.51 | 0.39 | 0.43 | 0.41 | 0.57 | — | — | — | — |
| Mn | 0.96 | 1.15 | 0.77 | 1.00 | 0.99 | 1.50 | — | 0.83 | — | 0.76 |
| $PO_4$ | 11.3 | 10.1 | 11.8 | 13.9 | 14.0 | 14.7 | 16.9 | 17.2 | 17.7 | 18.2 |
| $NO_3$ | 4.1 | 7.8 | 7.8 | 3.6 | 2.9 | 7.5 | 6.8 | 8.4 | 6.3 | 8.3 |
| Fe | .015 | .005 | .021 | .005 | .006 | .004 | .008 | .005 | .011 | .007 |
| F | 0.60 | — | 1.11 | — | 0.50 | 0.25 | 0.60 | 0.59 | 0.58 | 0.59 |
| AAO[1] | — | 15.0 | 5.0 | 2.0 | 1.0 | 5.0 | — | — | 1.0 | 2.0 |
| SNBS[2] | — | — | — | 0.26 | 0.32 | — | — | — | 0.26 | 0.23 |
| Chlorate | — | — | — | — | — | 2.2 | — | — | — | — |
| Nitrite | .095 | — | — | — | — | — | .095 | .095 | — | — |
| Free Acid[3] | 0.6 | 0.7 | 0.7 | 0.8 | 0.7 | 0.6 | 0.7 | 0.6 | 0.7 | 0.6 |
| Total Acid | 15.4 | 16.2 | 18.2 | 17.6 | 18.6 | 19.8 | 20.0 | 20.4 | 20.2 | 20.3 |

[1]AAO is an abbreviation for acetaldehyde oxime

[2]SNBS is an abbreviation for m-sodium nitrobenzene sulfonate

[3]Free Acid and Total Acid are measured in units of Points. Points are equal to milliequivalents per gram (meq/g) multiplied by 100. The milliequivalents of acidity in the sample is equal to the milliequivalents of base, typically potassium hydroxide, required to neutralize 1 gram of sample as determined by potentiometric titration.

TABLE II

Aqueous Acidic Zinc Phosphate Coating Compositions

| Concentration | EXAMPLE NUMBER | | | | | | |
|---|---|---|---|---|---|---|---|
| (grams/liter) | XI | XII | XIII | XIV | XV | XVI | XX |
| Zn | 0.88 | 0.98 | 0.93 | 1.01 | 1.05 | 1.71 | |
| Ni | 0.36 | — | — | — | — | — | |
| Mn | 0.92 | 1.00 | 0.97 | 1.01 | 1.06 | 0.28 | |
| W | — | — | — | — | — | 0.20 | |
| $PO_4$ | 11.9 | 8.3 | 8.0 | 8.6 | 8.7 | 4.70 | |
| $NO_3$ | 2.7 | 6.7 | 6.8 | 6.8 | 7.2 | 4.0 | |
| Fe | .006 | .002 | .003 | .008 | .016 | .015 | |
| Ca | — | 0.50 | 0.33 | 0.53 | 0.44 | — | |

TABLE II-continued

| Aqueous Acidic Zinc Phosphate Coating Compositions | | | | | | | |
|---|---|---|---|---|---|---|---|
| Concentration | EXAMPLE NUMBER | | | | | | |
| (grams/liter) | XI | XII | XIII | XIV | XV | XVI | XX |
| F | 0.47 | — | 0.20 | — | 0.21 | 0.55 | |
| AAO | 1.0 | — | — | 2.0 | 2.0 | 4.75 | |
| SNBS | 0.27 | — | — | 0.26 | 0.23 | — | |
| Chlorate | — | — | — | — | — | — | |
| Nitrite | — | .095 | .095 | — | — | — | |
| Free Acid | 0.6 | 0.6 | 0.9 | 0.8 | 1.3 | 0.5 | |
| Total Acid | 15.4 | 12.2 | 11.7 | 13.5 | 14.0 | 8.4 | |

TABLE III

| Test results on Cold Rolled Steel Substrate | | | | | | | | | | |
|---|---|---|---|---|---|---|---|---|---|---|
| | EXAMPLE NUMBER | | | | | | | | | |
| | I | II | III | IV | V | VI | VII | VIII | IX | X |
| Appearance[4] | N | P | P | P | C | P | C | C | C | C |
| Coating Weight ($g/m^2$) | 2.3 | 5.6 | 5.1 | 2.3 | 2.1 | 2.9 | 3.3 | 3.3 | 2.1 | 2.2 |
| Crystal Size (microns) | 2–4 | 10–20 | 2–7 | 5–20 | 1–7 | 4–12 | 2–6 | 2–6 | 2–8 | 2–8 |

[4]Appearance was determined by Scanning Electron Microscopy. In all of the examples complete coverage of the substrate with a continuous uniform, dense crystalline zinc phosphate coating was achieved. Crystal type varied depending on the zinc phosphate coating composition and the substrate. Nodular crystals are indicated as an "N", platelet crystals as a "P" and columnar crystals as a "C".

TABLE IV

| Test Results on Electrogalvanized Steel Substrate | | | | | | | | | | |
|---|---|---|---|---|---|---|---|---|---|---|
| | EXAMPLE NUMBER | | | | | | | | | |
| | I | II | III | IV | V | VI | VII | VIII | IX | X |
| Appearance | P | P | C | P | P | C | P | P | P | P |
| Coating Weight ($g/m^2$) | 2.5 | 2.5 | 2.8 | 2.3 | 2.9 | 2.7 | 4.1 | 3.5 | 3.1 | 3.1 |
| Crystal Size (microns) | 2–6 | 2–4 | 1–2 | 2–6 | 2–5 | 2–4 | 5–15 | 2–4 | 5–10 | 2–4 |

TABLE V

| Test Results on Hot Dip Galvanized Steel Substrate | | | | | | | | | | |
|---|---|---|---|---|---|---|---|---|---|---|
| | EXAMPLE NUMBER | | | | | | | | | |
| | I | II | III | IV | V | VI | VII | VIII | IX | X |
| Appearance | P | P | P | P | P | C | P | P | P | P |
| Coating Weight ($g/m^2$) | 2.4 | 2.5 | 3.2 | 3.0 | 2.8 | 2.0 | 4.8 | 3.9 | 4.2 | 3.8 |
| Crystal Size (microns) | 4–10 | 2–6 | 2–4 | 2–10 | 2–6 | 2–4 | 5–30 | 4–8 | 5–25 | 5–10 |

TABLE VI

Test results on Cold Rolled Steel Substrate

| | EXAMPLE NUMBER | | | | | |
|---|---|---|---|---|---|---|
| | XI | XII | XIII | XIV | XV | XVI |
| Appearance | P | P | C | P | C | P |
| Coating Weight ($g/m^2$) | 3.2 | 4.0 | 3.2 | 1.6 | 1.5 | 3.4 |
| Crystal Size (microns) | 10–20 | 2–8 | 2–6 | 5–15 | 2–6 | 1–2 |

TABLE VII

Test Results on Electrogalvanized Steel Substrate

| | EXAMPLE NUMBER | | | | | |
|---|---|---|---|---|---|---|
| | XI | XII | XIII | XIV | XV | XVI |
| Appearance | P | P | P | P | P | P |
| Coating Weight ($g/m^2$) | 3.6 | 2.9 | 3.8 | 1.8 | 2.6 | 2.9 |
| Crystal Size (microns) | 10–20 | 2–4 | 5–10 | 5–8 | 5–12 | 1–2 |

TABLE VIII

Test Results on Hot Dip Galvanized Steel Substrate

| | EXAMPLE NUMBER | | | | | |
|---|---|---|---|---|---|---|
| | XI | XII | XIII | XIV | XV | XVI |
| Appearance | P | P | P | P | P | P |
| Coating Weight ($g/m^2$) | 1.7 | 3.5 | 2.9 | 2.1 | 1.9 | 2.5 |
| Crystal Size (microns) | 3–6 | 5–12 | 5–12 | 5–25 | 2–8 | 1–2 |

TABLE IX

Aqueous Acidic Zinc Phosphate Concentrates Compositions

| Concentration | EXAMPLE NUMBER | | | | | |
|---|---|---|---|---|---|---|
| (grams/liter) | XVII | XVIII | XIX | XX | XXI | XXII |
| Zn | 15.4 | 37.4 | 30.8 | 22.4 | 18.6 | 24.6 |
| Ni | 8.6 | 10.2 | 7.8 | 8.6 | 8.2 | 11.4 |
| Mn | 19.2 | 23.0 | 15.4 | 20.0 | 19.8 | 30.0 |
| $PO_4$ | 226 | 202 | 236 | 278 | 280 | 294 |
| $NO_3$ | 82 | 156 | 156 | 72 | 58 | 150 |
| F | 12 | — | 22.2 | — | 10.0 | 5.0 |
| AAO | — | 300 | 100 | 40.0 | 20.0 | 100 |
| SNBS | — | — | — | 5.2 | 6.4 | — |
| Chlorate | — | — | — | — | — | 44.0 |

The aqueous acidic zinc phosphate concentrates of Table IX were prepared from the following mixture of ingredients:

TABLE X

| Weight Per- | EXAMPLE NUMBER | | | | | |
|---|---|---|---|---|---|---|
| cent % | XVII | XVIII | XIX | XX | XXI | XXII |
| Water | 39.84 | 44.31 | 43.64 | 43.90 | 47.88 | 22.89 |
| $H_3PO_4$ (75%) | 30.75 | 20.2 | 23.6 | 27.8 | 28.0 | 29.4 |
| $HNO_3$ (67%) | 9.76 | 20.5 | 21.3 | 8.2 | 6.2 | 19.2 |
| ZnO | 1.93 | 4.68 | 3.85 | 2.80 | 2.33 | 3.08 |
| MnO | 2.48 | 2.97 | 2.00 | 2.58 | 2.55 | 3.87 |
| $Ni(NO_3)_2$ | 6.14 | 7.34 | 5.61 | 6.20 | 5.90 | 8.20 |

TABLE X-continued

| Weight Per- | EXAMPLE NUMBER | | | | | |
|---|---|---|---|---|---|---|
| cent % | XVII | XVIII | XIX | XX | XXI | XXII |
| (14% Ni) | | | | | | |
| SNBS | — | — | — | 0.52 | 0.64 | — |
| KF (40%) | 9.10 | — | (16.8) | — | 2.50 | 3.79 |
| AAO (50%) | — | (60.0) | (20.0) | 8.0 | 4.0 | (20.0) |
| $NaClO_3$ | — | — | — | — | — | 9.57 |
| (46%) | | | | | | |
| Total Parts | 100 | 100 | 100 | 100 | 100 | 100 |

The water, phosphoric acid, nitric acid and acetaldehyde oxime are mixed together. The zinc oxide and manganese oxide are added to this solution. The remaining ingredients are then blended into the solution. An excess of phosphoric acid is used to ensure the complete solubility of the various constituents.

The ingredients can be added in different manners when preparing the concentrate. For example, the metal oxides can be added to a tank of rapidly mixing water to form a metal oxide slurry. The acids are then added to this slurry, followed by the remaining ingredients.

The concentrates would be prepared on site and shipped to the customer for use. A bath make-up concentrate is diluted in the customer's plant by 20 to 100 times with water (i.e., the diluted concentrates are used at between 1 and 5 percent by weight solids based on total weight of the concentrate.

The above examples of the aqueous acidic zinc phosphate coating compositions and concentrates demonstrate that oxime accelerated zinc phosphate compositions have equivalent or better performance over the prior art in terms of coverage and coating weight which are important factors with regard to corrosion resistance and adherence of subsequently applied paint. The oxime accelerated aqueous acidic zinc phosphate compositions are stable in a concentrate form, making a one-package system convenient for dilution and use in a pretreatment bath.

We claim:

1. An aqueous acidic composition for forming a zinc phosphate coating on a metal substrate comprising about 0.4 to 3.0 grams per liter (g/l) of zinc ion, about 5 to 20 g/l phosphate ion, and as an accelerator, about 0.5 to 20 g/l of an oxime.

2. The aqueous acidic composition as defined in claim 1 wherein said oxime is selected from the group consisting of acetaldehyde oxime and acetoxime.

3. The aqueous acidic composition as defined in claim 1 wherein said zinc ion is present in an amount of about 0.8 to 1.2 g/l.

4. The aqueous acidic composition as defined in claim 1 wherein said phosphate ion is present in an amount of about 12 to 14 g/l.

5. The aqueous acidic composition as defined in claim 1 further comprising about 0.1 to 2.5 g/l of fluoride ion.

6. The aqueous acidic composition as defined in claim 1 further comprising about 0 to 1.5 g/l of manganese ion.

7. The aqueous acidic composition as defined in claim 1 further comprising about 0 to 1.8 g/l of nickel ion.

8. The aqueous acidic composition as defined in claim 1 further comprising about 1 to 10 g/l of nitrate ion.

9. The aqueous acidic opposition as defined in claim 1 further comprising a metal ion selected from the group consisting of cobalt, calcium and magnesium ions.

10. The aqueous acidic composition as defined in claim 1 further comprising an additional accelerator selected from the group consisting of hydrogen peroxide, sodium nitrobenzene sulfonate, and chlorate ion present in an amount of from 0.005 to 5.0 g/l.

11. The aqueous acidic composition as defined in claim 10 wherein said sodium nitrobenzene sulfonate is present in an amount of about 0.1 to 0.5 g/l.

12. The aqueous acidic composition as defined in claim 1 wherein said oxime is selected from the group consisting of oximes that are soluble and stable in aqueous acidic compositions and do not prematurely decompose and lose activity at a pH of between 2.5 and 5.5 for a sufficient time to accelerate the formation of zinc phosphate coating on metal substrates.

13. An aqueous acidic composition for forming a zinc phosphate coating on a metal substrate comprising about 0.8 to 1.2 g/l of zinc ion, about 12 to 14 g/l of phosphate ion, about 0.25 to 1.0 g/l of fluoride ion, about 0.8 to 1.0 g/l of manganese ion, about 0.3 to 0.8 g/l of nickel ion, about 2 to 5 g/l of nitrate ion, and as accelerators about 0.3 g/l of sodium nitrobenzene sulfonate, and about 1 to 5 g/l of acetaldehyde oxime.

14. An aqueous acidic concentrate comprising about 10 to 100 g/l of zinc ion, about 100 to 400 g/l of phosphate ion, and as an accelerator, about 10 to 400 g/l of an oxime.

15. The aqueous acidic concentrate as defined in claim 14 wherein said oxime is selected from the group consisting of acetaldehyde oxime and acetoxime.

16. The aqueous acidic concentrate as defined in claim 14 wherein said zinc ion is present in an amount of about 16 to 20 g/l.

17. The aqueous acidic concentrate as defined in claim 14 wherein said phosphate ion is present in an amount of about 240 to 280 g/l.

18. The aqueous acidic concentrate as defined in claim 14 wherein said oxime is present in amounts of from about 10 to 40 g/l.

19. The aqueous acidic concentrate as defined in claim further comprising about 2 to 30 g/l fluoride ion.

20. The aqueous acidic concentrate as defined in claim further comprising about 4 to 40 g/l manganese ion.

21. The aqueous acidic concentrate as defined in claim 14 further comprising about 4 to 24 g/l nickel ion.

22. The aqueous acidic concentrate as defined in claim 14 further comprising about 20 to 200 g/l nitrate ion.

23. The aqueous acidic concentrate as defined in claim 14 including a metal ion selected from the group consisting of cobalt, calcium and magnesium ions.

24. The aqueous acidic concentrate as defined in claim 14 further comprising an additional accelerator selected from the group consisting of hydrogen peroxide, sodium nitrobenzene sulfonate, and chlorate ion in an amount in the concentrate to result in an amount of additional accelerator of from 0.005 to 5.0 g/l in an aqueous acidic composition formed by diluting the aqueous acidic concentrate from 20 to 100 times.

25. A process for forming a zinc phosphate coating on a metal substrate comprising contacting the metal with an aqueous acidic zinc phosphate composition comprising about 0.4 to 3.0 grams per liter (g/l) of zinc ion, about 5 to 20 g/l phosphate ion, and as an accelerator, about 0.5 to 20 g/l of an oxime.

26. The process as defined in claim 25 wherein said oxime is selected from the group consisting of acetaldehyde oxime and acetoxime.

27. The process as defined in claim 26 wherein said oxime is present in an amount of about 1.to 5 g/l.

28. The process as defined in claim 25 wherein said aqueous acidic zinc phosphate composition contains about 0.8 to 1.2 g/l of zinc ion.

29. The process as defined in claim 25 wherein said aqueous acidic zinc phosphate composition contains about 12 to 14 g/l of phosphate ion.

30. The process as defined in claim 25 wherein said aqueous acidic zinc phosphate composition contains about 0.1 to 2.5 g/l of fluoride ion.

31. A metal substrate containing from 1.0 to 6.0 grams per square meter ($g/m^2$) of a zinc phosphate conversion coating applied by contacting the metal with an aqueous acidic zinc phosphate composition comprising about 0.4 to 3.0 grams per liter (g/l) of zinc ion, about 5 to 20 g/l phosphate ion, and as an accelerator, about 0.5 to 20 g/l of an oxime.

32. The metal substrate of claim 31 wherein the metal is selected from the group consisting of ferrous metals, steel, zinc and zinc alloys, aluminum and aluminum alloys and mixtures thereof.

33. The metal substrate of claim 32 wherein the steel substrate is selected from the group consisting of galvanized steel, steel alloys, and mixtures thereof.

* * * * *

UNITED STATES PATENT AND TRADEMARK OFFICE

CERTIFICATE OF CORRECTION

PATENT NO. : 5,588,989

DATED : December 31, 1996

INVENTOR(S) : Vonk et al.

It is certified that error appears in the above-identified patent and that said Letters Patent is hereby corrected as shown below:

Column 11, line 38, insert --14-- after the word "claim".
Column 11, line 40, insert --14-- after the word "claim".
Column 12, line 1, delete "including" and insert --further comprising--.

Signed and Sealed this

Tenth Day of November 1998

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,588,989

DATED : December 31, 1996

INVENTOR(S) : Vonk et al.

It is certified that error appears in the above-identified patent and that said Letters Patent is hereby corrected as shown below:

Column 10, line 64, delete "opposition" and insert "composition".
Column 11, line 38, insert --14-- after the word "claim".
Column 11, line 40, insert --14-- after the word "claim".
Column 12, line 1, delete "including" and insert --further comprising--.

Signed and Sealed this

Twenty-fourth Day of November, 1998

*Attest:*

Bruce Lehman

BRUCE LEHMAN

*Attesting Officer*

*Commissioner of Patents and Trademarks*